US008151383B2

(12) United States Patent
Feener

(10) Patent No.: US 8,151,383 B2
(45) Date of Patent: Apr. 10, 2012

(54) JUVENILE BATHING UNIT

(75) Inventor: Richard Allen Feener, Canton, MA (US)

(73) Assignee: Cosco Management, Inc., Wilmington, DE (US)

( * ) Notice: Subject to any disclaimer, the term of this patent is extended or adjusted under 35 U.S.C. 154(b) by 1261 days.

(21) Appl. No.: 11/845,586

(22) Filed: Aug. 27, 2007

(65) Prior Publication Data

US 2008/0066225 A1 Mar. 20, 2008

Related U.S. Application Data

(60) Provisional application No. 60/840,468, filed on Aug. 28, 2006.

(51) Int. Cl.
*A47K 3/024* (2006.01)

(52) U.S. Cl. ..... 4/572.1

(58) Field of Classification Search ..... 4/572.1, 4/579, 578.1, 582; 248/467
See application file for complete search history.

(56) References Cited

U.S. PATENT DOCUMENTS

| | | | | |
|---|---|---|---|---|
| 2,645,781 | A | 7/1953 | Mover | |
| 3,289,217 | A * | 12/1966 | Glover | 4/562.1 |
| 3,528,111 | A | 9/1970 | Chou | |
| 3,995,331 | A | 12/1976 | Fotre et al. | |
| 4,837,871 | A | 6/1989 | Wheeler | |
| 5,010,606 | A | 4/1991 | Bernstein et al. | |
| 5,158,460 | A * | 10/1992 | Bernstein et al. | 4/572.1 |
| 5,181,284 | A | 1/1993 | Raphael et al. | |
| 5,388,286 | A | 2/1995 | Davenport | |
| 5,599,063 | A | 2/1997 | Lister et al. | |
| 5,687,433 | A | 11/1997 | Garner et al. | |
| 5,829,070 | A | 11/1998 | Taylor | |
| 5,857,226 | A | 1/1999 | Sommer | |
| 6,253,392 | B1 | 7/2001 | Conforti et al. | |
| 6,314,592 | B1 | 11/2001 | Stein | |
| 6,457,190 | B1 | 10/2002 | Stein | |
| 6,507,959 | B1 | 1/2003 | Sundberg et al. | |
| 6,834,400 | B2 * | 12/2004 | Zanardelli et al. | 4/572.1 |
| 7,058,995 | B2 | 6/2006 | Sundberg et al. | |
| 2005/0060799 | A1 | 3/2005 | Zanardelli et al. | |
| 2005/0229302 | A1 | 10/2005 | Sundberg et al. | |

* cited by examiner

*Primary Examiner* — Dinh Nguyen
*Assistant Examiner* — Viet Le
(74) *Attorney, Agent, or Firm* — Barnes & Thornburg LLP

(57) ABSTRACT

A juvenile bathing unit includes a baby bath seat and a seat mounting bracket coupled to the baby bath seat. The seat mounting bracket includes a rim clamp configured to be mounted on a rim of a bath rub to hold the baby bath seat in the bath tub.

14 Claims, 5 Drawing Sheets

JUVENILE BATHING UNIT

This application claims priority under 35 U.S.C. §119(e) to U.S. Provisional Application Ser. No. 60/840,468, filed Aug. 28, 2006, which is expressly incorporated by reference herein.

BACKGROUND

The present disclosure relates to a baby bath seat, and particularly to a baby bath seat configured to be mounted on a bath tub. More particularly, the present disclosure relates to a mounting bracket associated with a baby bath seat and configured to be mounted on a rim of the bath tub.

SUMMARY

In accordance with the present disclosure, a juvenile bathing unit includes a baby bath seat and a seat mounting bracket. The seat mounting bracket is configured to provide means for mounting the baby bath seat on a rim of a bath tub to locate the baby bath seat on a floor provided in an interior bathing region formed in the bath tub.

In illustrative embodiments, the seat mounting bracket includes vertically oriented inner and outer supports and a horizontally oriented bridge interconnecting the inner and outer supports. The inner support is coupled to the baby bath seat. The seat mounting bracket is configured to define means for clamping the rim of the bath tub between the inner and outer supports to hold the baby bath seat in a stationary position relative to the bath tub.

The bridge is arranged to overlie a portion of the bath tub rim when the juvenile bathing unit is mounted on a bath tub to locate the baby bath seat in the bath tub. The bridge of the seat mounting bracket includes a coupler plate and a plurality of rim couplers coupled to the coupler plate. The rim couplers are configured to provide means for releasably mating with a top wall of the bath tub rim to resist upward movement of the seat mounting bracket away from the rim when the juvenile bathing unit is mounted on the bath tub using the clamping means further to hold the baby bath seat in a stationary position on the floor of the bath tub.

In an illustrative embodiment, each rim coupler includes a suction cup and a mounting element coupled to the coupler plate of the bridge and to the suction cup. Each suction cup includes a pliable vacuum-grip dome having an outer perimeter edge and a vacuum-release tab appended to the outer perimeter edge. Movement of the vacuum-release tab by a user relative to the bath tub rim deforms the vacuum-grip dome to release any suction-producing vacuum provided between the vacuum-grip dome and the bath tub rim to permit separation of the seat mounting bracket from the bath tub rim and removal of the juvenile bathing unit from the bath tub once the clamping force applied by the clamping means is released. The vacuum-release tab is located in a space provided between the coupler plate of the seat mounting bracket and the rim of the bath tub so that the vacuum-release tab can be accessed and gripped by a user and then moved relative to the coupler plate and rim to dissipate any vacuum extant in a vacuum-grip dome included in the suction grip including the vacuum-release tab.

Additional features of the present disclosure will become apparent to those skilled in the art upon consideration of the following detailed description of the illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
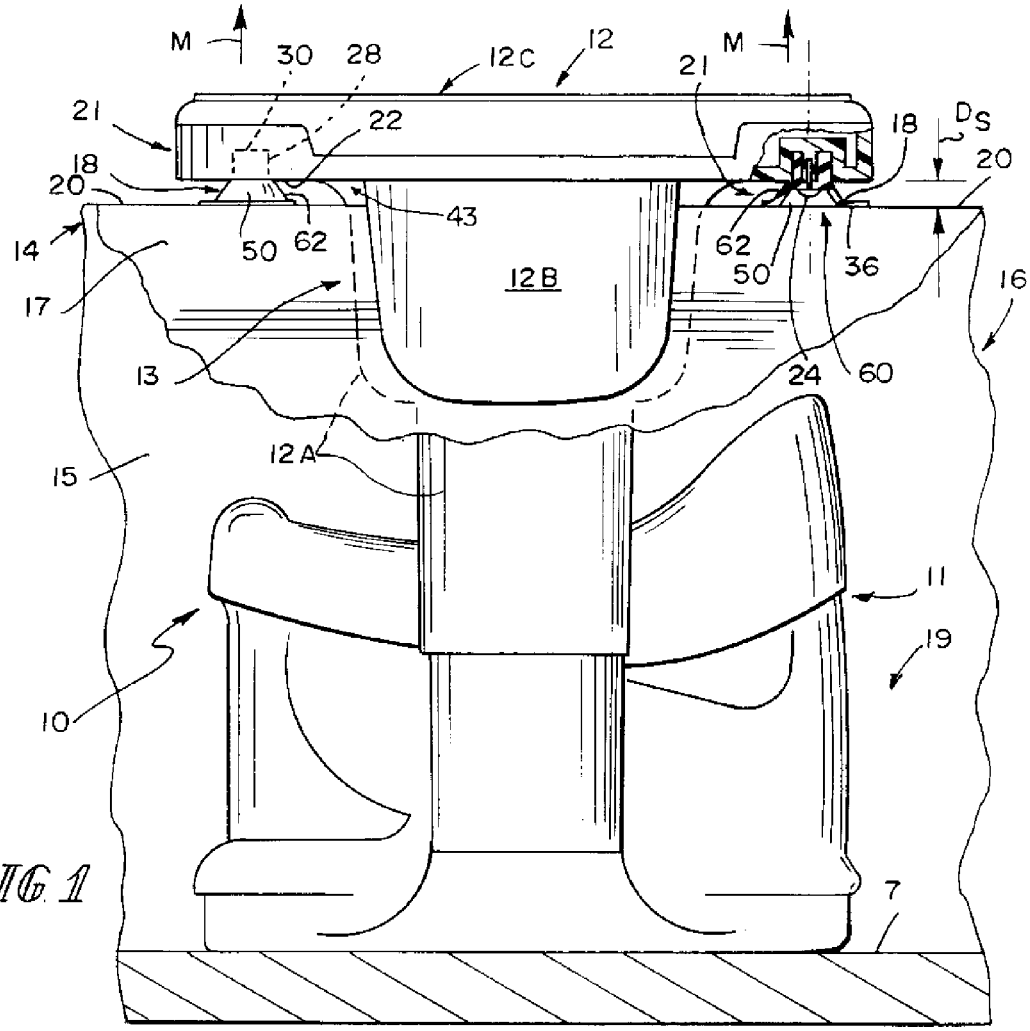
FIG. 1 is a side elevational view of a juvenile bathing unit, according to the present disclosure, including a baby bath seat and a seat mounting bracket coupled to the baby bath seat and mounted on a rim of a bath tub, the seat mounting bracket including a pair of suction cups releasably coupled to a top wall of the bath tub rim to resist an upward movement of the seat mounting bracket away from the bath tub rim as suggested by arrows M, and further showing, in cross-section, one of the suction cups being coupled to a bridge including horizontal coupler plate included in the seat mounting bracket by a fastener inserted through a fastener-receiving aperture extending through the suction cup and opening on an underside of the suction cup.
Figure 3:
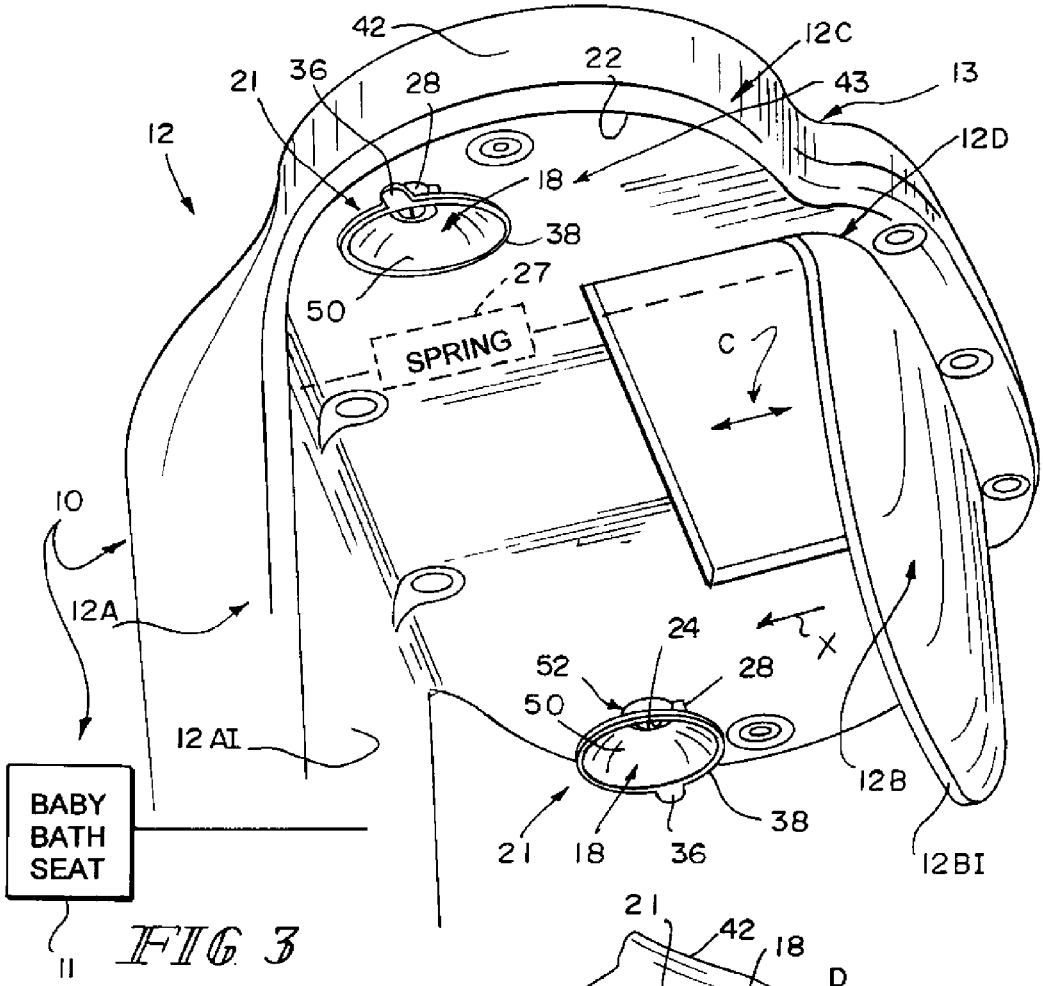
FIG. 3 is an enlarged partial perspective view of the underside of the seat mounting bracket of FIG. 1 showing the pair of suction cups coupled to an underside of the coupler plate included in the bridge and showing that each of the suction cups includes a downwardly opening vacuum-grip dome and a vacuum-release tab coupled to an outer perimeter edge of the vacuum-grip dome.
Figure 4:
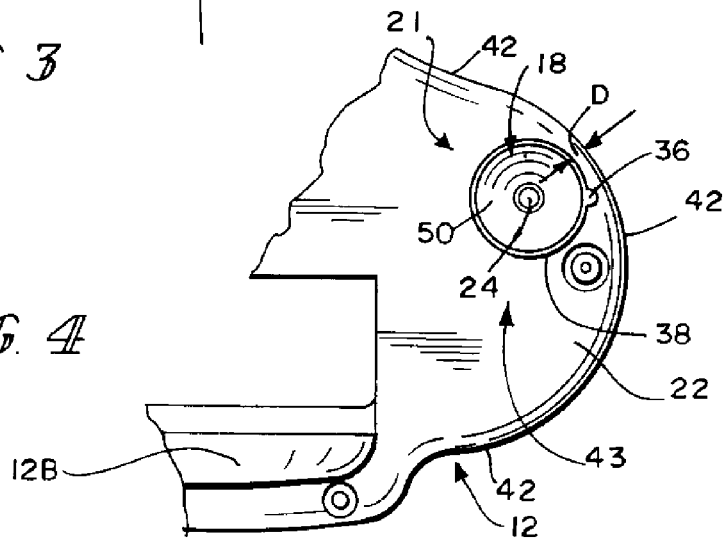
FIG. 4 is a partial bottom view of the seat mounting bracket of FIG. 3 showing that the outer perimeter edge of the vacuum-grip dome is setback a distance "D" from an outer edge of the coupler plate of the bridge and showing that the vacuum-grip dome and the vacuum-release tab lie within a "bridge" region bounded by the outer edge of the coupler plate.
Figure 8:
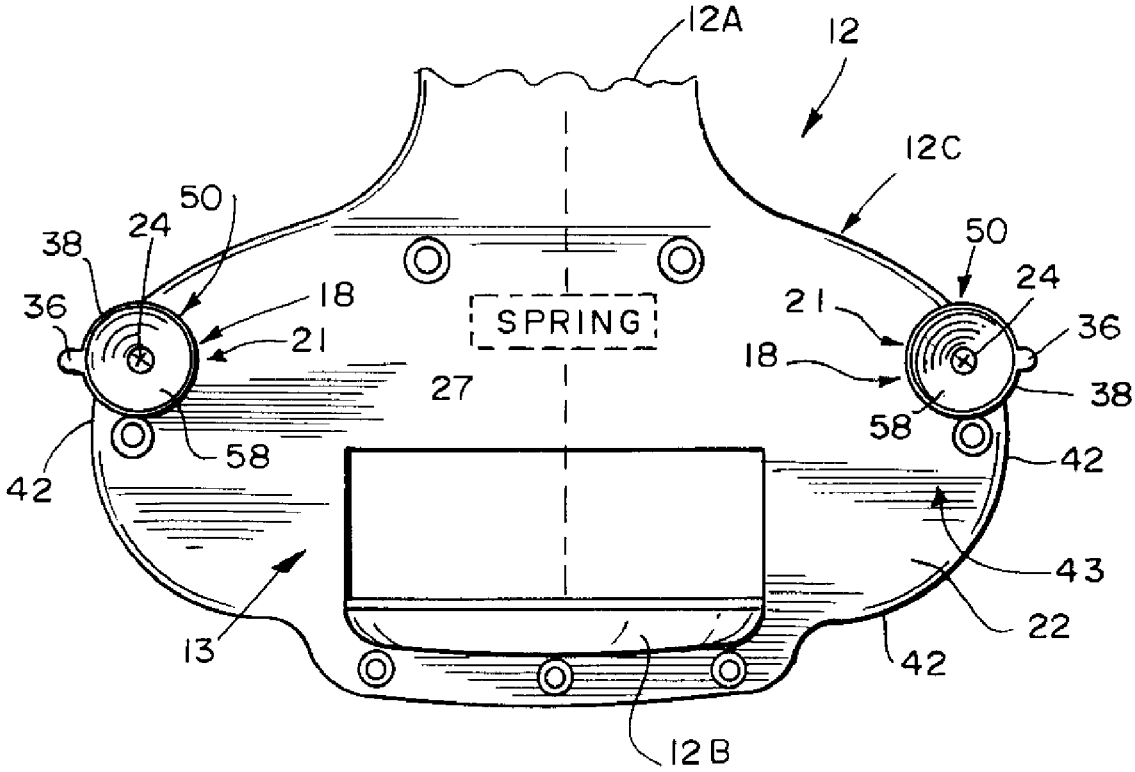
FIG. 8 is a bottom view of a portion of the seat mounting bracket of a juvenile bathing unit according to another embodiment of the present disclosure, showing a pair of suction cups and further showing that each suction cup includes a vacuum-grip dome and a vacuum-release tab coupled to a perimeter edge of the vacuum-grip dome and that a portion of each vacuum-grip dome and vacuum-release tab extends beyond an outer edge of a coupler plate included in the bridge of a seat mounting bracket and coupled to the suction cups.

A juvenile bathing unit 10 in accordance with the present disclosure includes a baby bath seat 11 and a seat mounting bracket 12 coupled to baby bath seat 11 as suggested illustratively in FIG. 1 and diagrammatically in FIG. 3. Mounting bracket 12 is configured to be mounted on a rim 14 of a bath tub 16 to cause baby bath seat 11 to rest on a floor 7 of bath tub 16 as suggested in FIG. 1. Seat mounting bracket 12 includes a rim clamp 13 and at least one suction cup 18 having a vacuum-release tab 36 shown, for example, in FIG. 6 that can be accessed, gripped, and moved by a user as suggested in FIG. 5 to release any suction-producing vacuum established by suction cup 18. One illustrative location of vacuum-release tab 36 is shown in FIG. 4 and another illustrative location of vacuum-release tab 36 is shown in FIG. 8.

Rim 14 includes portions of an inner wall 15, an outer wall 17, and a top wall 20 interconnecting inner and outer walls 15, 17. Tub floor 7 and inner walls 15 cooperate to an interior bathing region 19, providing a bath water reservoir. Baby bath seat 11 is held in a stationary position in interior bathing region 19 of bath tub 16 when seat mounting bracket 12 is mounted on rim 14 and retained on rim 14 using suction cups 18 included in seat mounting bracket 12.

As suggested in FIGS. 1 and 3, seat mounting bracket 12 includes a rim clamp 13 including, in an illustrative embodiment, a substantially vertically oriented inner support 12A configured to provide inner means for engaging inner wall 15 of bath tub rim 14 and a substantially vertically oriented outer support 12B configured to provide outer means for engaging outer wall 17 of bath tub rim 14. Seat mounting bracket 12 also includes a substantially horizontally oriented bridge 12C interconnecting the inner and outer supports 12A, 12B and configured to provide means for overlying top wall 20 of bath tub rim 14.

Bridge 12C includes a coupler plate 22 and a plurality of rim couplers 21 appended to coupler plate 22 and arranged to extend downwardly from coupler plate 22 as suggested in FIGS. 1 and 3. Each rim coupler 21 is configured to provide vacuum means for releasably mating with top wall 20 of bath tub rim 14 to resist vertical or upward movement, as suggested by arrows M in FIG. 1, of seat mounting bracket 12 relative to and away from top wall 20 of bath tub rim 14 when juvenile bathing unit 10 is mounted on bath tub 16 using rim clamp 13. Each rim coupler 21, shown, for example, in FIGS. 1-3 and 8, includes a suction cup 18 and a cup fastener 24.

Outer support 12B of seat mounting bracket 12 is configured to be adjustable to size seat mounting bracket 12 to fit and clamp to bath tub rims 14 of different widths, such as a width of top wall 20, as suggested by arrows C in FIG. 3. Rim clamp 13 of seat mounting bracket 12 includes a spring 27 configured to provide means for normally yieldably urging inner and outer supports 12A, 12B to move toward one another to grip a bath tub rim 14 (of varying width) there between to anchor (e.g., clamp) seat mounting bracket to bath tub rim 14. Spring 27 moves inner and outer supports 12A, 12B toward one another to establish a clamping force that acts on bath tub rim 14 to resist vertical movement M of seat mounting bracket 12 relative to top wall 20 of bath tub rim 14.

Outer support 12A and inner support 12B may include a slip-resistant material, which may be a cushioned material as well, on their respective interior surfaces 12AI and 12BI to assist both supports 12A, 12B in cooperating with suction cups 18 to resist vertical and upward movement M of seat mounting bracket 12 relative to top wall 20 of bath tub rim 14. It is within the scope of the present disclosure to configure suction cups 18 to resist side-to-side movement of seat mounting bracket 12 along top wall 20 of bath tub rim 14.

Figure 2:
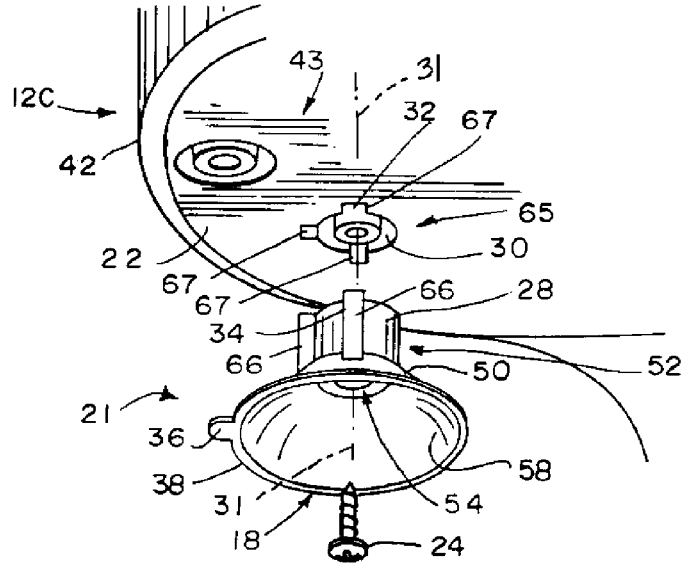
FIG. 2 is an enlarged partial perspective assembly view of the underside a portion of the seat mounting bracket of FIG. 1 showing one of the suction cups configured to be coupled to the overlying coupler plate of the seat mounting bracket using a fastener inserted into a fastener-receiving aperture having an opening in the underside of the suction cup, and further showing anti-rotation lugs included in the suction cup and arranged to fit into lug receivers formed in the coupler plate of the seat mounting bracket to prevent rotation of the suction cup about a vertical axis relative to the bridge of the seat mounting bracket.

Each suction cup 18 comprises a vacuum-grip dome 50, a vacuum-release tab 36 coupled to vacuum-grip dome 50, and a dome mount 52 coupled to vacuum-grip dome 50 as shown, for example, in FIG. 2. Cup fastener 24 is arranged to pass through a fastener-receiving opening 54 formed in vacuum-grip dome 50 and dome mount 52 as suggested in a first embodiment shown in FIGS. 1-4 and in a second embodiment shown in FIGS. 6 and 7. Suction cup 18 is a monolithic element in an illustrative embodiment.

Figure 7:
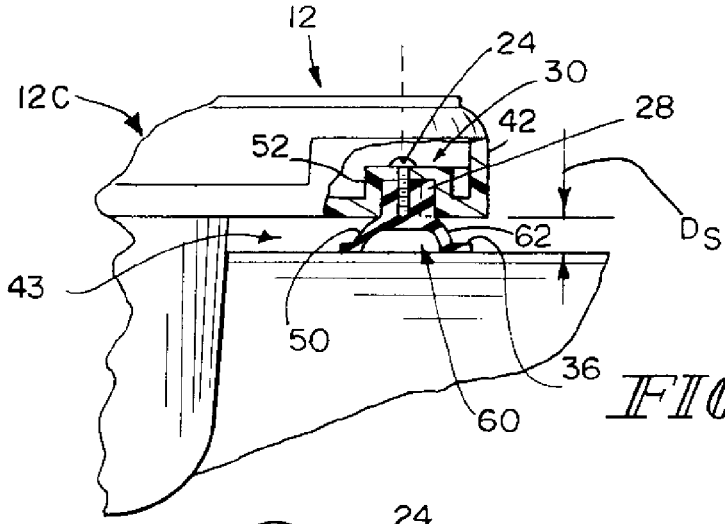
FIG. 7 is an enlarged partial side elevational view, with portions broken away, showing that the horizontal coupler plate of the bridge and the top wall of the bath tub rim are separated by a "set-off" distance "$D_S$" to permit a user to reach and lift a vacuum-release tab included in the suction cup, as shown in FIG. 5.

Vacuum-grip dome 50 is made of a pliable elastic material and is formed to include downwardly opening bowl-shaped underside 58 arranged to face toward top wall 20 of bath tub rim 14 when juvenile bathing unit 10 is mounted on bath tub 16 as shown, for example in FIGS. 1 and 7. Bowl-shaped underside 58 cooperates with top wall 20 to form a hollow space 60 therebetween in which a vacuum may be created to anchor suction cup 18 to top wall 20 of bath tub rim 14 to retain juvenile bathing unit 10 in a stationary position relative to bath tub 16.

Figure 5:
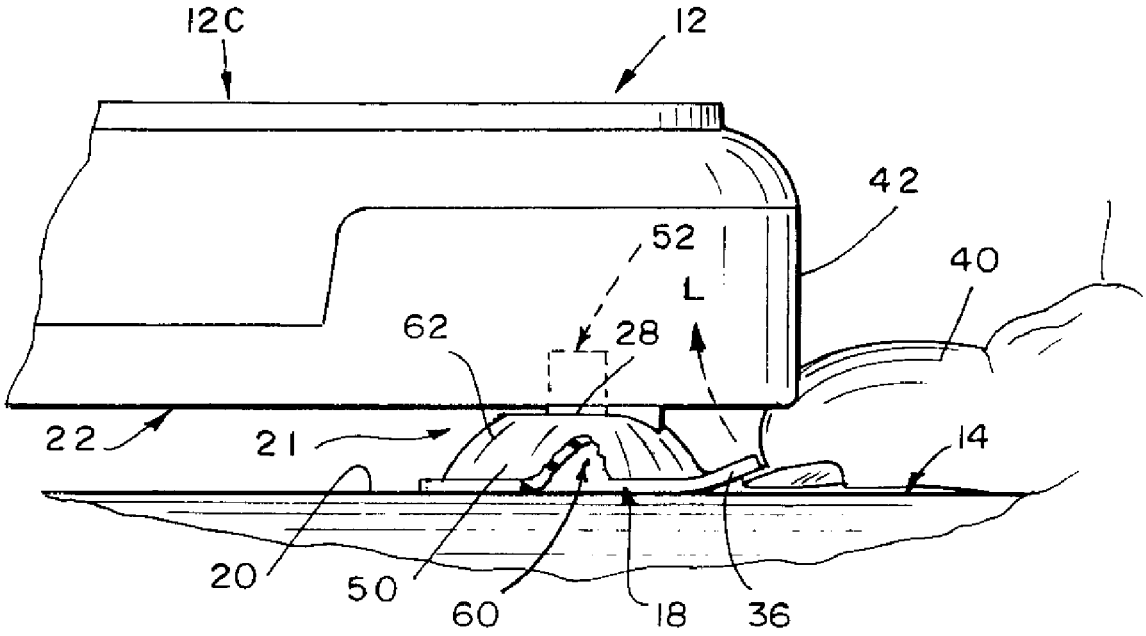
FIG. 5 is an enlarged side elevational view of the portion of the seat mounting shown in FIG. 4, with portions broken away, showing mating engagement of the vacuum-grip dome of the suction cup and an underlying top wall of a rim of a bath tub and showing a user lifting the vacuum-release tab of the suction cup away from the top wall of the bath tub rim in an effort to dissipate a vacuum established in a hollow space provided between an underside of the vacuum-grip dome and the top wall of the bath tub rim.

Vacuum-grip dome 50 is also formed to include a top side 62 arranged to face away from top wall 20 of bath tub rim 14 when juvenile bathing unit 10 is mounted on bath tub 16 as shown, for example, in FIGS. 1, 5 and 7. Dome mount 52 is coupled to top side 62 of vacuum-grip dome 50 as suggested in FIG. 6.

Figure 6:
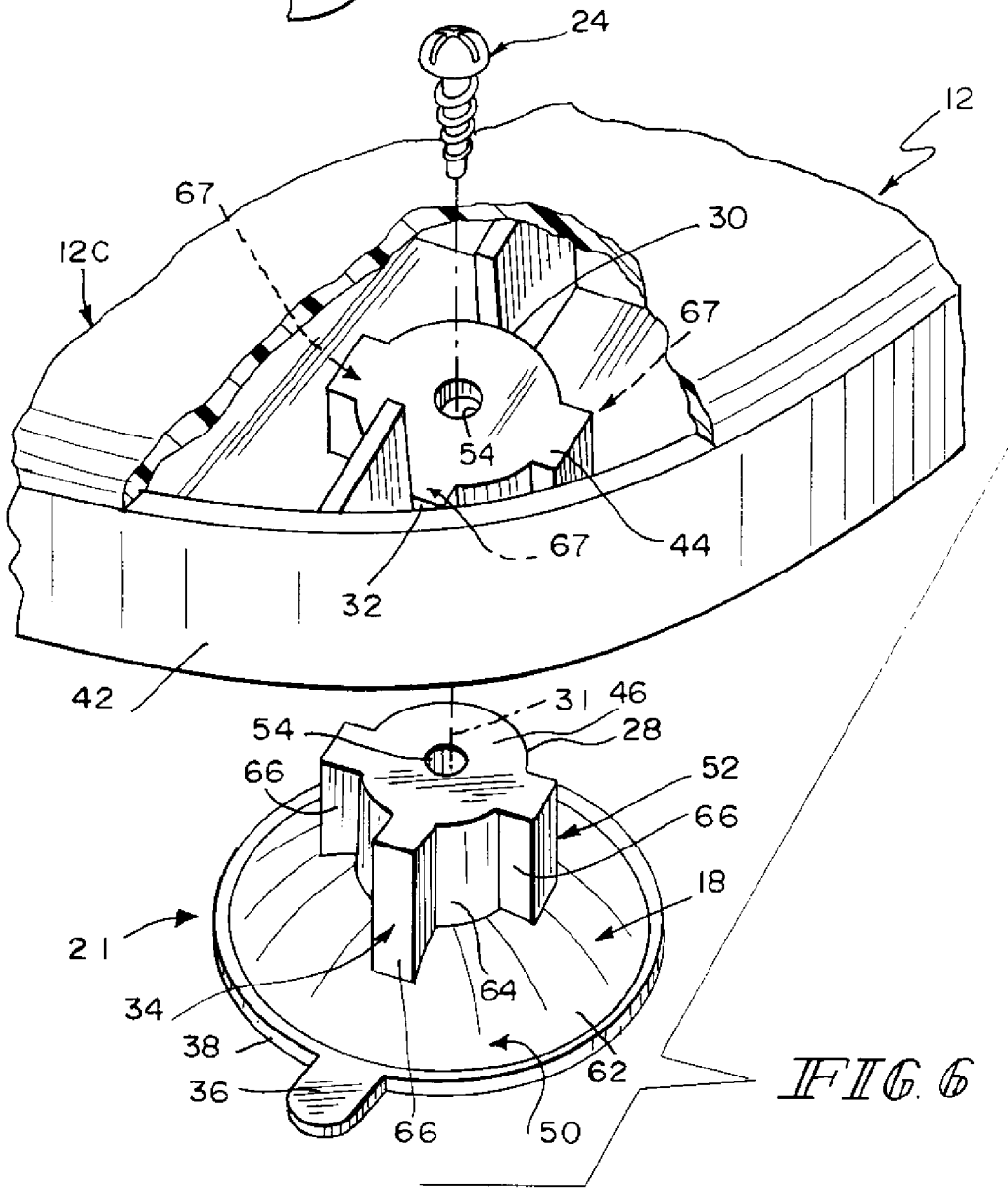
FIG. 6 is a perspective exploded assembly view of a portion of the seat mounting bracket of FIGS. 1-5, with portions broken away, showing a suction cup including a vacuum-grip dome, a vacuum-release tab coupled to a perimeter edge of the vacuum-grip dome, and a dome mount coupled to a peak of the vacuum-grip dome and formed to include an upstanding post and three anti-rotation lugs coupled to a cylinder-shaped exterior wall of the upstanding post and to a top side of the vacuum-grip dome.

Dome mount 52 is coupled to a convex peak of vacuum-grip dome 50 as suggested in FIG. 6. Dome mount 52 includes an upstanding post 64 having a cylinder-shaped exterior wall and several (e.g., three) anti-rotation lugs 66 coupled to the cylinder-shaped exterior wall of upstanding post 64. Anti-rotation lugs 66 are arranged to lie in spaced-apart relation to one another on the exterior surface of upstanding post 64 as shown best in FIG. 6. Anti-rotation lugs 66 are also coupled to top side 62 of vacuum-grip dome 50 as shown best in FIG. 6. Each anti-rotation lug 66 is sized and located to extend into a companion lug receiver 67 formed in coupled plate 22 as suggested in FIG. 2 to block rotation of suction cup 18 about axis 31 relative to coupler plate 22 of bridge 12C.

In an illustrated embodiment, mounting elements 28 and 30 are complementarily configured. That is, mounting element 28 provided by upstanding post 52 is an illustrative embodiment configured to fit inside a complementarily configured mounting element 30 (defined by a post-receiving cavity in an illustrative embodiment) such that at least a portion 32 of mounting element 28 mates with at least a portion 34 of mounting element 28 such that when the mounting elements 28, 30 are inter-engaged, they cooperate to prevent rotation of mounting element 28 relative to mounting element 30, and thus prevent rotation of suction cup 18 relative to seat mounting bracket 12, as suggested in FIG. 2. It is within the scope of the present disclosure that mounting elements 28, 30 may be complementarily configured to mate with each other such that mounting element 30 fits inside mounting element 28.

In an illustrated embodiment, each suction cup 18 also includes a vacuum-release tab 36 located on and coupled to (e.g. cantilevered) an outer circumference or outer perimeter edge 38 of each vacuum-grip dome 50. Vacuum-release tab 36 permits a user 40 to lift vacuum-release tab 36 upwardly in order to release the suction effect established by a vacuum extant in hollow space 60 in vacuum-grip dome 50 of suction cup 18, as suggested by arrow L in FIG. 5, thereby permitting seat mounting bracket 12 of juvenile bathing unit 10 to be dismounted from bath tub 16 once any "rim-clamping" forces generated by rim clamp 13 are removed.

In an illustrated embodiment, suction cups 18 are configured to be mounted such that an outer circumference 38 of each vacuum-grip dome 50 is set back, for example, a distance D from an outer edge 42 of seat mounting bracket 12 and vacuum-release tab 36 is likewise contained inside outer edge 42 as well, as shown in FIGS. 4 and 5.

In an illustrated embodiment, suction cup 18 is configured to be coupled to seat mounting bracket 12 by, for example, screw 24 inserted through a top 44 of mounting element 28 of mounting bracket 12 and into a top 46 of mounting element 28 of suction cup 18, as suggested in FIGS. 6 and 7. Mounting elements 28 and 30 cooperate, by the mounting of respective portions 34 and 32, as discussed above regarding the embodiment of FIG. 2, to prevent rotation of suction cup 18 relative to seat mounting bracket 12 about axis 31.

As shown in FIGS. 1 and 7, a mounting of suction cup 18 to seat mounting bracket 12 either from below or above suction cup 18, results in a "set-off" mounting depth $D_s$ of suction cup 18 relative to the underside 26 of seat mounting bracket 12. When vacuum-grip domes 50 are mounted such that outer circumference 38 and vacuum-release tab 36 are completely within outer edge 42 of seat mounting bracket 12, mounting depth $D_s$ permits user 40 to reach and lift vacuum-release tab 36 on vacuum-grip dome 50, as shown in FIG. 5.

In an illustrated embodiment, suction cups 18 are configured to be coupled to coupler plate 22 of bridge 12C of seat mounting bracket 12 such that a portion of outer circumference 38 and at least a portion of vacuum-release tab 36 are positioned outside of or external to a "bridge" region 43 bounded by outer edge 42 of seat mounting bracket 12, as shown in FIG. 8. Suction cups 18 may be coupled to seat mounting bracket 12 by screws 24 from "below" suction cup 18, as shown in FIG. 8, or from "above" suction cup 18, as shown in FIGS. 6 and 7.

It is within the scope of the present disclosure that a plurality of suction cups 18 may be coupled to coupler plate 22 of seat mounting bracket 12 at a variety of different locations along or on coupler plate 22. It is also within the scope of the present disclosure that suction cups 18 may be arranged in a variety of combinations of suction cups 18 located entirely within or having portions of suction cups 18 external to outer edge 42 of seat mounting bracket 12. It is within the scope of the present disclosure that a single, large suction cup may be used in place of the plurality of suction cups 18 shown herein and that the size and shape of suction cups 18 may be varied.

A juvenile bathing unit 10 includes a baby bath seat 11 and a seat mounting bracket 12 coupled to baby bath seat 11 as suggested in FIGS. 1 and 3. Seat mounting bracket 12 is configured to include anchor means for gripping a rim 14 of a bath tub 16 to retain baby bath seat 11 in an interior bathing region 19 formed in bath tub 16. The anchor means includes a rim clamp 13 including a bridge 12C, an inner clamp plate 12A, an outer clamp plate 12B, and a plate mover 12D. Bridge 12C is adapted to overlie a top wall 20 of bath tub rim 14. Inner clamp plate 12A is associated with bridge 12C and adapted to engage an inner wall 15 of a bath tub 16. Outer clamp plate 12B is mounted for movement on (or relative to) the bridge 12C for movement toward and away from inner clamp plate 12A to engage an outer wall 17 of a bath tub 16. Plate mover 12D is configured to move inner and outer clamp plates 12A and 12B relative to one another to apply a clamping force to bath tub rim 14 located between inner and outer clamp plates 12A and 12B.

The anchor means further includes a suction cup 18 coupled to an underside of bridge 12C. Suction cup 18 is configured to provide vacuum means for releasably mating with top wall 20 of bath tub rim 14 when inner and outer clamp plates 12A and 12B are moved to engage inner and outer walls 15, 17 of bath tub 16 to resist upward movement of seat mounting bracket 12 away from bath tub rim 14 so that baby bath seat 11 is retained in a stationary position on a floor 27 of bath tub 16 while seat mounting bracket 12 is retained on bath tub rim 14.

Suction cup 18 includes a vacuum-grip dome 50 made of a pliable material and a dome mount 52 coupled to vacuum-grip dome 50 and to bridge 12C of rim clamp 13. Vacuum-grip dome 50 is deformable to mate with top wall 20 of the rim 14 of bath tub 16 and establish a vacuum in a hollow space 60 formed between vacuum-grip dome 50 and top wall 20 of bath tub rim 14.

Suction cup 18 further includes a vacuum-release tab 36 coupled to vacuum-grip dome 50 and configured to provide means for deforming vacuum-grip dome 50 to dissipate any vacuum extant in hollow space 60 to allow movement of bridge 12C of rim clamp 13 away from bath tub rim 14. Vacuum-grip dome 50 includes a peak coupled to dome mount 52 and an outer perimeter edge 38 arranged to surround the peak. Vacuum-release tab 36 is coupled to outer perimeter edge 38 and arranged to extend away from vacuum-grip dome 50.

Bridge 12C is a plate having an outer edge 42 providing a boundary defining a bridge region 43 directly below bridge 12C. Vacuum-grip dome 50 and vacuum-release tab 36 are arranged to lie wholly within the bridge region 43 in the embodiment illustrated in FIGS. 1-7. Vacuum-grip dome 50 is arranged to allow only a portion of outer perimeter edge 38 to lie outside of bridge region 43 and vacuum-relief tab 36 is arranged to lie wholly outside of bridge region 43 in the embodiment illustrated in FIG. 8.

Bridge 12C is formed to include a post receiver and a tab receiver. Dome mount 52 includes an upstanding post 64 coupled to the vacuum-grip dome 50 and arranged to extend into the post receiver 65 formed in coupler plate as suggested in FIG. 2. Dome mount 52 further includes several anti-rotation tabs 66 coupled to upstanding post 64 and arranged to extend into tab receiver 67 to block rotation of vacuum-grip dome 50 about an axis 31 intersecting bridge 12C.

Suction cup 18 further includes a fastener 24 arranged to extend through a fastener-receiving aperture 54 formed in the vacuum-grip dome 50 and upstanding post 64. Fastener 24 is coupled to bridge 12C to retain vacuum-grip dome 50 in a fixed position on bridge 12C as suggested in FIGS. 1 and 7.

The invention claimed is:

1. A juvenile bathing unit comprising a baby bath seat and a seat mounting bracket coupled to the baby bath seat and configured to include anchor means for gripping a rim of a bath tub to retain the baby bath seat in an interior bathing region formed in the bath tub, the anchor means including a rim clamp including a bridge adapted to overlie a top wall of a rim of the bath tub, an inner clamp plate associated with the bridge and adapted to engage an inner wall of a bath tub, an outer clamp plate mounted for movement on the bridge for movement toward and away from the inner clamp plate to engage an outer wall of a bath tub, and a plate mover configured to move the inner and outer clamp plates relative to one another to apply a clamping force to a rim of a bath tub located between the inner and outer clamp plates, and wherein the anchor means further includes a suction cup coupled to an underside of the bridge and configured to provide vacuum means for releasably mating with the top wall of the rim of the bath tub when the inner and outer clamp plates are moved to engage inner and outer walls of the bath tub to resist upward movement of the seat mounting bracket away from the rim of the bath tub so that the baby bath seat is retained in a stationary position on a floor of the bath tub while the seat mounting bracket is retained on the rim of the bath tub, wherein the suction cup includes a vacuum-grip dome made of a pliable material and a dome mount coupled to the vacuum-grip dome and to the bridge of the rim clamp and the vacuum-grip dome is deformable to mate with the top wall of the rim of the bath tub and establish a vacuum in a hollow space formed between the vacuum-grip dome and the top wall of the rim of the bath tub, and wherein the bridge is formed to include a post receiver and a tab receiver and the dome mount includes an upstanding post coupled to the vacuum-grip dome and arranged to extend into the post receiver and an anti-rotation tab coupled to the upstanding post and arranged to extend into the tab receiver to block rotation of the vacuum-grip dome about an axis intersecting the bridge.

2. The juvenile bathing unit of claim 1, wherein the suction cup further includes a vacuum-release tab coupled to the vacuum-grip dome and configured to provide means for deforming the vacuum-grip dome to dissipate any vacuum extant in the hollow space to allow movement of the bridge of the rim clamp away from the rim of the bath tub.

3. The juvenile bathing unit of claim 2, wherein the vacuum-grip dome includes a peak coupled to the dome mount and an outer perimeter edge arranged to surround the peak and the vacuum-release tab is coupled to the outer perimeter edge and arranged to extend away from the vacuum-grip dome.

4. The juvenile bathing unit of claim 3, wherein the bridge is a plate having an outer edge providing a boundary defining a bridge region directly below the bridge, the vacuum-grip dome is arranged to allow only a portion of the outer perimeter edge to lie outside of the bridge region, and the vacuum-relief tab is arranged to lie wholly outside of the bridge region.

5. The juvenile bathing unit of claim 1, wherein the suction cup further includes a fastener arranged to extend through a fastener-receiving aperture formed in the vacuum-grip dome and the upstanding post and coupled to the bridge to retain the vacuum-grip dome in a fixed position on the bridge.

6. A juvenile bathing unit comprising a baby bath seat and a seat mounting bracket adapted for attachment to a rim of a bath tub, the baby bath seat being coupled to the seat mounting bracket, the seat mounting bracket including a substantially vertically oriented inner support configured to provide inner means for engaging an inner wall of the bath tub, a substantially vertically oriented outer support configured to provide outer means for engaging an outer wall of the bath tub, and a substantially horizontally oriented bridge interconnecting the inner and outer supports and being configured to provide means for overlying a top wall of the rim of the bath tub, and wherein the bridge includes a coupler plate and a plurality of rim couplers coupled to the coupler plate and arranged to extend downwardly from the coupler plate and the rim couplers are configured to provide means for releasably mating with the top wall of the rim of the bath tub to resist vertical movement of the mounting bracket relative to the top wall when the juvenile bathing unit is mounted on the bath tub, and wherein each rim coupler includes a suction cup and a first mounting element coupled to the suction cup, the bridge further includes a second mounting element coupled to the plate, and the first and second mounting elements are mated to one another and cooperate to prevent rotation of the first mounting element relative to the second mounting element.

7. The juvenile bathing unit of claim 6, wherein the first mounting element includes a first portion configured to fit inside a complementarily configured second portion of the second mounting element and the first and second portions inter-engage each other when the first and second mounting elements are mated.

8. The juvenile bathing unit of claim 6, wherein each suction cup includes a vacuum-grip dome and an outer perimeter edge and a vacuum-release tab appended to the vacuum-grip dome and the vacuum-release tab is configured to be lifted by a user to separate vacuum-grip dome on the top wall of the rim of the bath tub thereby permitting the seat mounting bracket to be dismounted from the bath tub.

9. The juvenile bathing unit of claim 8, wherein the bridge further includes an outer edge and the outer perimeter edge of the vacuum-grip dome and the entire vacuum-release tab are contained inside the outer edge.

10. The juvenile bathing unit of claim 9, wherein the bridge further includes an outer edge and at least a portion of one of the outer perimeter edge of the vacuum-grip dome and the vacuum-release tab are positioned outside the outer edge.

11. The juvenile bathing unit of claim 6, wherein each suction cup includes a vacuum-grip dome having an outer perimeter edge and a vacuum-release tab appended to the outer perimeter edge, and the suction cups are coupled to the bridge such that a set-off mounting depth is created between the coupler plate of the bridge and the top wall of the rim thereby permitting a user to reach into the mounting depth and lift the vacuum-release tab of the suction cup to release a suction effect established by the suction cup so that the seat mounting bracket can be dismounted from the bath tub.

12. The juvenile bathing unit of claim 6, wherein the inner support, the outer support, and the plurality of rim couplers cooperate to releasably mount the seat mounting bracket to the rim of the bath tub in order to resist vertical movement of the seat mounting bracket relative to the top wall of the rim of the bath tub.

13. The juvenile bathing unit of claim 6, wherein the outer support is biased in a direction toward the outer wall of the bath tub to exert a clamping force on the outer wall and to cooperate with the inner support to resist vertical movement of the seat mounting bracket relative to the top wall when the seat mounting bracket is mounted on the bath tub.

14. A juvenile bathing unit comprising a baby bath seat and a seat mounting bracket adapted for attachment to a rim of a bath tub, the baby bath seat being coupled to the seat mounting bracket, the seat mounting bracket including a substantially vertically oriented inner support configured to provide inner means for engaging an inner wall of the bath tub, a substantially vertically oriented outer support configured to provide outer means for engaging an outer wall of the bath tub, and a substantially horizontally oriented bridge interconnecting the inner and outer supports and being configured to provide means for overlying a top wall of the rim of the bath tub, and wherein the bridge includes a coupler plate and a plurality of rim couplers coupled to the coupler plate and arranged to extend downwardly from the coupler plate and the rim couplers are configured to provide means for releasably mating with the top wall of the rim of the bath tub to resist vertical movement of the mounting bracket relative to the top wall when the juvenile bathing unit is mounted on the bath tub, wherein each rim coupler includes a suction cup coupled to the bridge and configured to provide vacuum means for releasably mating with the rim of the bath tub, and wherein the plurality of rim couplers comprises two rim couplers and each rim coupler includes a mounting element and a suction cup coupled to and extending downwardly from the coupler plate of the bridge.

* * * * *